US006107555A

United States Patent [19]

Hoshino

[11] Patent Number: 6,107,555

[45] Date of Patent: Aug. 22, 2000

[54] TOOL CONNECTING ADAPTOR FOR THE DRUM

[75] Inventor: Yoshihiro Hoshino, Nagoya, Japan

[73] Assignee: Hoshino Gakki Kabushiki Kaisha, Japan

[21] Appl. No.: 09/228,145

[22] Filed: Jan. 11, 1999

[51] Int. Cl.[7] ..... G10D 13/02

[52] U.S. Cl. ..... 84/421; 84/327

[58] Field of Search ..... 84/421, 327, 328, 84/329; 248/443, 635; 224/910

[56] References Cited

U.S. PATENT DOCUMENTS

| | | | |
|---|---|---|---|
| 1,330,814 | 2/1920 | Meyer | 84/421 |
| 5,454,288 | 10/1995 | Hoshino | 84/421 |
| 5,544,561 | 8/1996 | Isomi | 84/421 |
| 5,797,569 | 8/1998 | Simons | 248/187.1 |

FOREIGN PATENT DOCUMENTS

| | | | |
|---|---|---|---|
| 3045576 | 6/1981 | Germany | 84/421 |
| 3339397 | 5/1995 | Germany | 84/421 |
| 2270192 | 3/1994 | United Kingdom | 84/421 |
| 2274735 | 8/1994 | United Kingdom | 84/421 |

*Primary Examiner*—Robert E. Nappi
*Assistant Examiner*—Kim Lockett
*Attorney, Agent, or Firm*—Ostrolenk, Faber, Gerb & Soffen, LLP

[57] ABSTRACT

An adaptor for attaching a tool to a drum hoop. A first member that comprises a first horizontal seating plate, a vertical front plate and an upper engaging part at the top of the front plate extending forward of the seating plate and toward the drum. An opening in the front plate and the opening having a bottom edge facing front toward the drum body. A second member includes a second seating plate normally disposed above the first seating plate of the first member. A hanging part depending from the second seating plate passes through the opening of the front plate of the first member and depends below the first seating plate. A lower drum hoop engaging part on the hanging part. A screw in the second seating plate is adjustable against the first seating plate for moving those seating plates apart, thereby to move the upper and lower engaging parts together against the hoop. A side plate at each lateral side of the hanging part engages the rear side of the front plate of the front part.

6 Claims, 7 Drawing Sheets

TOOL CONNECTING ADAPTOR FOR THE DRUM

BACKGROUND OF THE INVENTION

The present invention relates to an adaptor for connecting a tool to a drum and particularly an adaptor which is capable of connecting various tools to the drum hoop or rim. The drum hoop at each drum head is secured around the end of the drum body and secures the drum head to the drum body.

An example of a support structure for a drum is disclosed in Japanese Publication Toku Kai Hei 7-210154, (disclosed in U.S. Pat. No. 5,454,288) for instance. As shown in FIG. 7 herein, a plurality of hoop side installation parts 65 are integrally provided on the drum hoop 62. The hoop tightens the drum head 61 over the end of the drum 60 and is fixed to the drum body by fixing elements 63.

An arm-side installation part 75 of the arm 71 of the drum support 70 is fixed against each of the hoop-side installation parts 65 with bolts and nuts, thereby installing the support tool 70 on the drum 60.

Using a structure in which a support is installed on a drum hoop through a plurality of installation parts, the drum load is dispersed and stably supported, as compared with prior art structures wherein the support tool is directly installed on the body of the drum. Also, this kind of drum has a superior effect, in that vibrations of the drum body are prevented from being transmitted to the side of the support member, thereby improving the resonant function of the drum.

The aforementioned structure pertains to the drum that has the installation part integrally installed on the drum hoop. It cannot be used for an ordinary drum having no such installation part.

Further, that structure pertains to a drum support. However, a similar improvement in the stable support and resonant function can be achieved not only for a support tool but also for some other tool, such as a microphone or an accessory.

SUMMARY OF THE INVENTION

The invention provides a tool connecting adaptor for a drum which is adapted for installing a support tool or various kinds of tools on the drum hoop and even on a normal drum that does not have an installation part. In addition, the tool-connecting adaptor is capable of stably holding various tools because it is fixed firmly and simply to a ring shaped drum hoop.

The tool connecting adaptor for a drum comprises the members for connecting tools being freely detachably engaged to the outside of the drum.

The adaptor for attaching a tool to a drum and particularly to the hoop of a drum around the drum body includes a first member comprising a first horizontal seating plate, a vertical front plate upstanding from the seating plate and an upper drum hoop engaging part at the top of the front plate extending forward of the seating plate and toward the drum. An opening formed in the front plate has a bottom edge that faces front toward the drum body. The adaptor further includes a second member comprising a second seating plate which is normally disposed above the first seating plate of the first member. A hanging part depending from the second seating plate passes through the opening of the front plate of the first member and depends below the first seating plate. A lower drum hoop engaging part is defined on the hanging part.

An adjustment device, in the form a screw in the second seating plate, is adjustable against the first seating plate for moving the seating plates apart, for moving the upper and lower engaging parts together and against the hoop. A side plate is positioned at each lateral side of the hanging part for engaging the rear side of the front plate of the front part.

The first and second members engage where the hanging part engages the front edge of the first seating plate at the bottom of the opening in the first seating plate. The side plates next to the hanging part engage the rear of the upstanding front plate of the first member. The adjustment screws on the one seating plate engage the second seating plate, so that the adjustment screws enabling affixation of the adaptor on the drum hoop.

Other features and advantages of the present invention will become apparent from the following description of the invention which refers to the accompanying drawings.

DETAILED DESCRIPTION OF THE INVENTION

Figure 1:
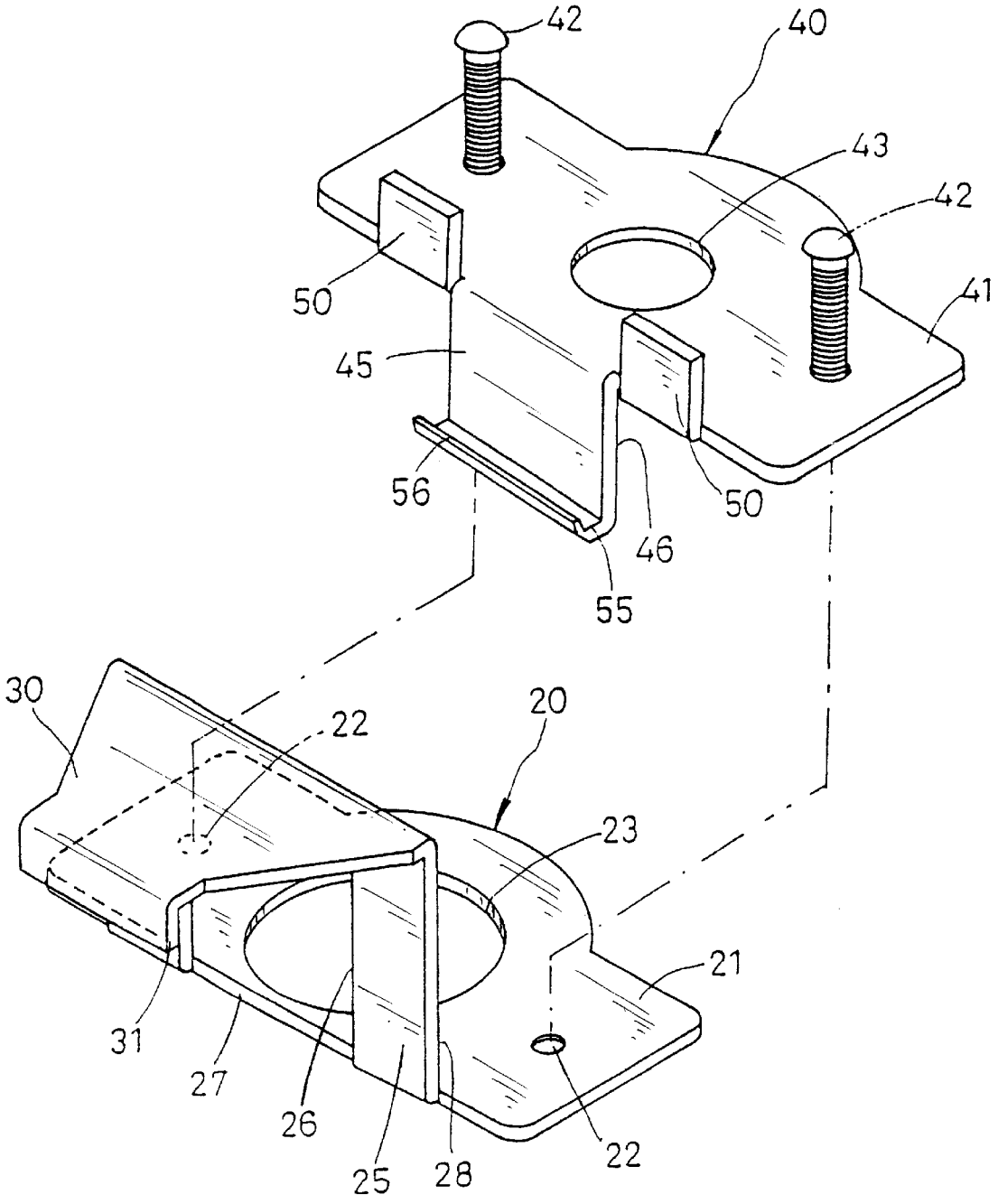
FIG. 1 is an oblique exploded view of an example of a tool connecting adaptor for a drum according to the invention.
Figure 2:
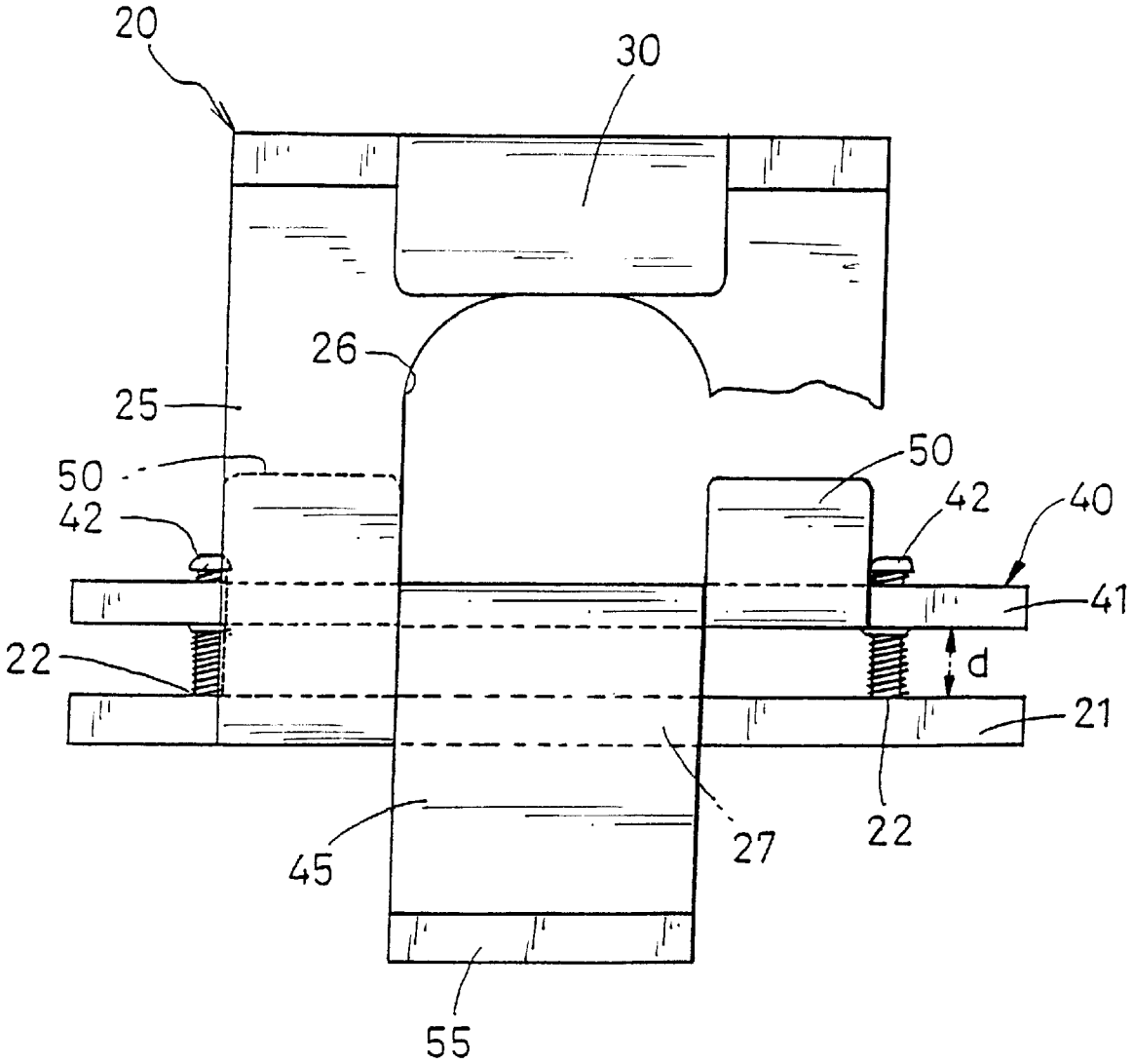
FIG. 2 is a front view of the adaptor in its combined state, with a part thereof being shown as a cut surface.

A tool connecting adaptor 10 for a drum according to the invention provides a connection for installing various tools, such as a drum support member, etc., on a drum hoop. The hoop serves for tightening the drum head on the drum body as described above. As shown in FIGS. 1 and 2, the adaptor comprises a combination of a first member 20 and a second member 40 which are detachably engaged on the outside of the drum hoop.

The first member 20 includes a first horizontal seating plate 21 that extends outward from the drum body, a vertical front plate 25 upstanding from the front drum facing edge of the first plate and a horizontal upper engaging part 30, shown at the lower left side in FIG. 1 which projects from the top of the plate 25 and away from the seating plate 21.

The first seating plate 21 has screw receivers 22 at the right and left sides on the seating plate surface. An installation screw 42 of the second member 40 is applied against or in the screw receiver 22. Although the screw receiver 22 can have the same surface as the seating plate surface, the receiver may be formed as a slight concave, as is shown in the example, and the screws 42 do not pass through the receivers 22. There is an installation hole 23 in the first seating plate for tool connection.

The front plate 25 is erected integrally at the front edge of and extends above of the first seating plate 21. The plate 25 has a central opening 26 defined by a vertically oriented, horizontally extending edge 27 across its lateral center, as shown in FIG. 1. The front plate 25 has a rear surface 28.

The upper engaging plate 30 of the first member 20 extends forward of the top edge of the vertical plate 25 and in the direction opposite the plate 21. The underside of the upper plate 30 engages the top of the drum hoop. There is an engaging claw 31 on the upper 30.

The second member 40 has a second horizontal seating plate 41, a central hanging part 45, an upstanding side plate 50 at each side of the hanging part 45 and a lower engaging part 55, as shown at the top right in FIG. 1.

The second seating plate 41 receives installation screws 42 that are screwed back and forth in the vertical direction through holes in the seating surface of the plate 41. The tips of the installation screws 42 are received on the screw receiving recesses 22 in the first seating plate 21. An installation hole 43 for tool connection is formed in the second seating plate 41 aligned with the hole 23.

The central hanging part 45 is integrally attached to and hangs down from the front edge of the second seating plate 41. The rear surface 46 of the hanging part 45 engages the lower edge 27 of the central opening 26 in the first member 20 when the members 20 and 40 are assembled together as in FIGS. 3.

In addition, the side pates 50 on both sides of the central hanging part 45 engage the rear surface 28 of the front plate 25 of the first member 20 in a freely sliding manner.

The lower engaging part 55 at the lower part of the central hanging part 45 engages the lower side of the drum hoop via an engaging claw 56.

The first and second members 20, 40 are combined as shown in FIG. 2. The central hanging part 45 of the second member 40 is passed through and depends below the opening 26 in the front plate 25 of the first member 20, and the side plates 50 of the second member 40 engage the rear surface 28 of the front plate 25 of the first member 20. At the same time, the installation screw 42 that has been screwed into the second seating plate 41 of the second member 40 is tightened against the screw receiver 22 of the first seating plate 21 for advancement, thereby separating the plates by a gap d between the first seating plate 21 of the first member 20 and the second seating plate 41 of the second member 40. This presses the upper engaging part 30 of the first member 20 and the lower engaging part 55 of the second member 40 respectively at the top and bottom of the drum hoop for fixing the elements together.

Connecting the tool connecting adaptor 10 on the drum hoop H is explained with reference to FIGS. 3.

Figure 3A:
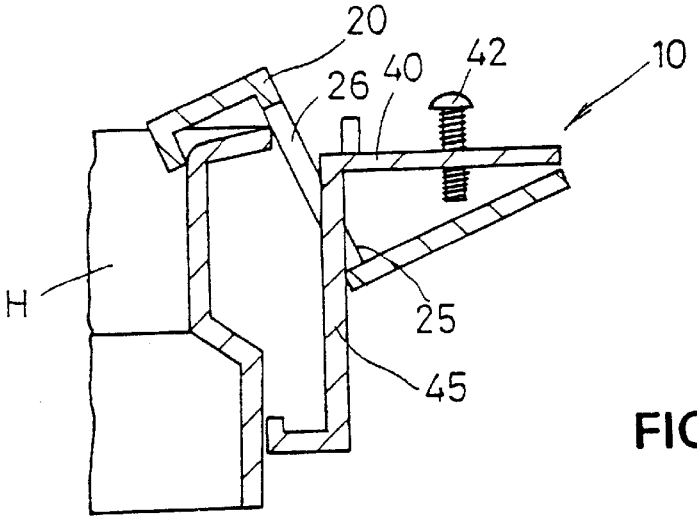
FIGS. 3A, 3B and 3C show stages of engagement of the connecting adaptor with the drum hoop.

First, the connecting adaptor 10 is arranged at a prescribed installation position around the drum hoop H. The central hanging part 45 of the second member 40 is inserted into the opening 26 of the front plate 25 of the first member 20, as shown in FIG. 3A. The installation screw 42 of the second member 40 had been earlier pulled back.

Figure 3B:
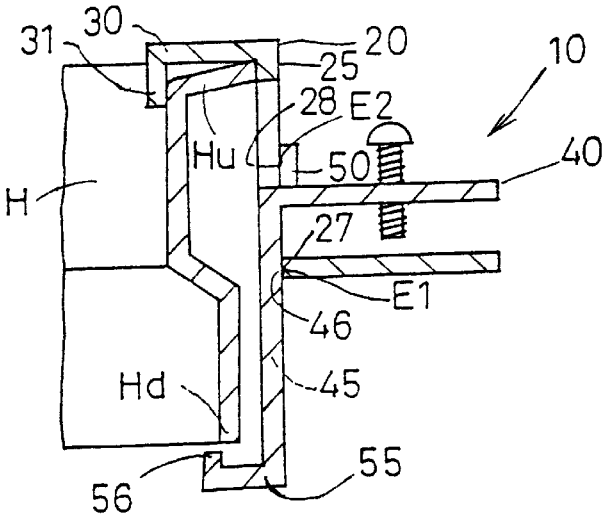

Next, the upper engaging part 30 at the top of the front plate 25 of the first member 20 is arranged on the upper side Hu of the drum hoop H, while the lower engaging part 55 of the lower portion of the central hanging part 45 of the second member 40 is arranged on the lower side Hd of the drum hoop H at their respective engagement locations, as shown in FIG. 3B.

Then the rear surface 46 of the central hanging part 45 of the second member 40 is engaged, at E1, with the lower edge 27 of the opening 26 of the first member 20, while the side plates 50 of the second member 40 are engaged with the rear surface 28 of the front plate 25 of the first member 20 at E2. This makes it impossible to move the first member 20 and the second member 40 at least in the forward and rearward directions (in the right and left directions in the drawing) because of the engagement of parts at two locations E1 and E2.

The installation screws 42 in the second seating plate 41 of the second member 40 are screwed downward toward the first seating plate 21 of the first member 20, until they contact the screw receivers 22. Upon further advancing the installation screws 42, the first seating plate 21 and the second seating plate 41 are further separated from each other, as shown in FIG. 3C, expanding the gap d while the members 20 and 40 do not tilt relative to each other, due to the engagements at E1 and E2.

Figure 3C:
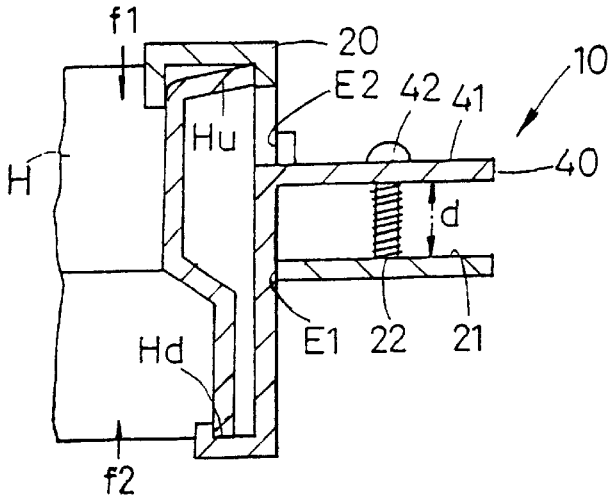

Since the first member 20 and the second member 40 can slide vertically, even though their movement in the forward and rearward directions is restricted as described above, expansion of the gap d between the first and second seating plates 21, 41 causes the upper engaging part 30 of the first member 20 and the lower engaging part 55 of the second member 40 to move closer mutually in an inward direction, as shown by arrows f1 and f2 in FIG. 3C. This causes the upper engaging part 30 and the lower engaging part 55 to firmly engage the upper side Hu and the lower side Hd of the drum hoop H, respectively.

The outwardly directed force to separate the first seating plate 21 and the second seating plate 41, due to the advancement of the installation screws 42, produces an inward force on the upper engaging part 30 and the lower engaging part 55 that sandwiches the drum hoop H. This also affords a strong engaging force to the engaging elements at locations E1 and E2 which are located between the engaging parts 30 and 55. The first member 20 and the second member 40 produce a strong binding force, thereby firmly supporting the load that is produced on the sides of the drum and the adaptor and, at the same time, preventing vibrations from being produced.

This firmly installs the connective adaptor 10 on the drum hoop H. For removing the adaptor 10, the installation screw 42 is turned back opposite to the direction described above, and the gap between the first and the second seating plates 21, 41 is narrowed, which separates the upper engaging part 30 of the first member 20 and the lower engaging part 55 of the second member 40 in the outward direction and off the drum hoop H, thereby releasing the engagement.

Figure 4:
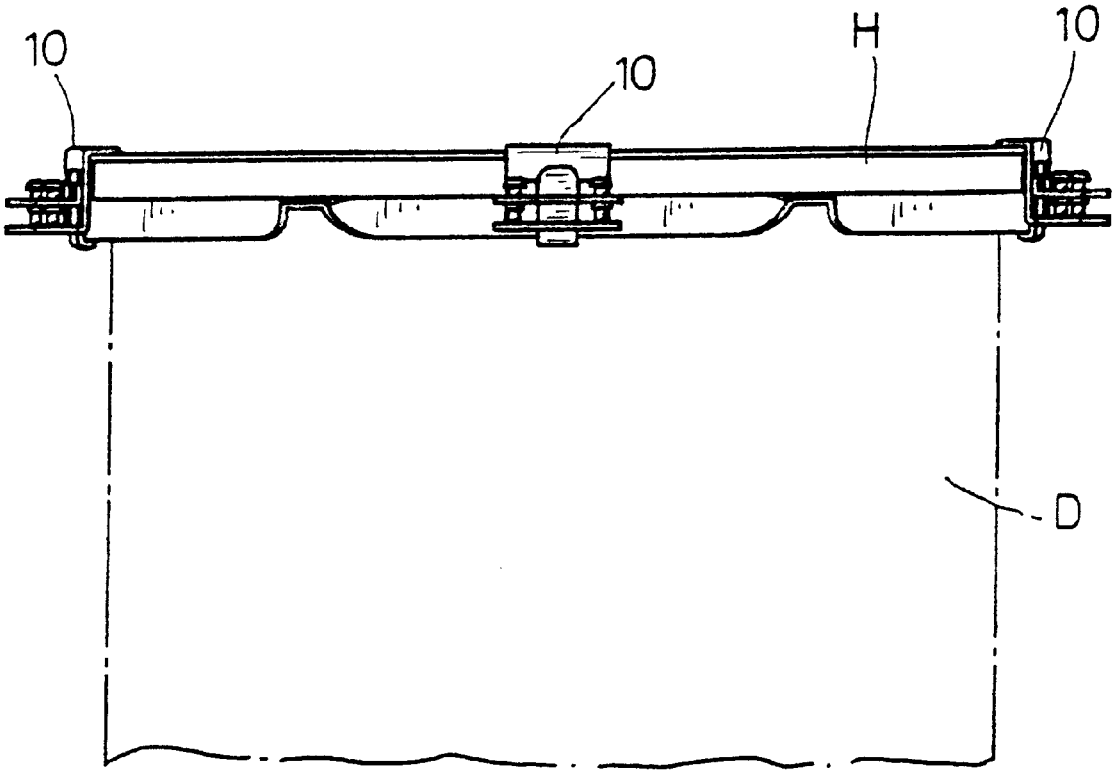
FIG. 4 is a side view showing the state in which the connecting adaptor has been installed on the drum hoop.
Figure 5:
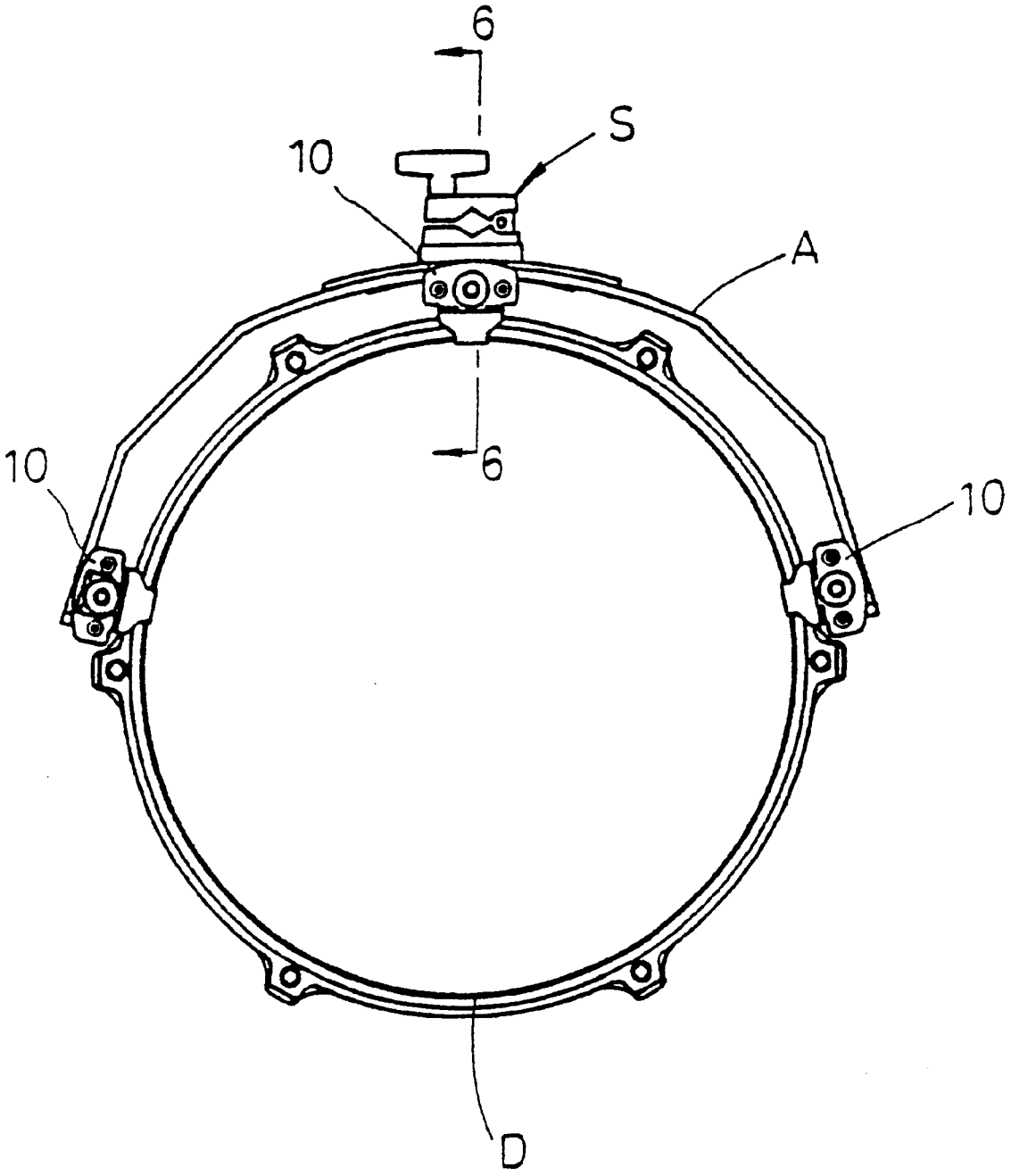
FIG. 5 is a plane view showing the state in which the support member has been installed through the connecting adaptor.
Figure 6:
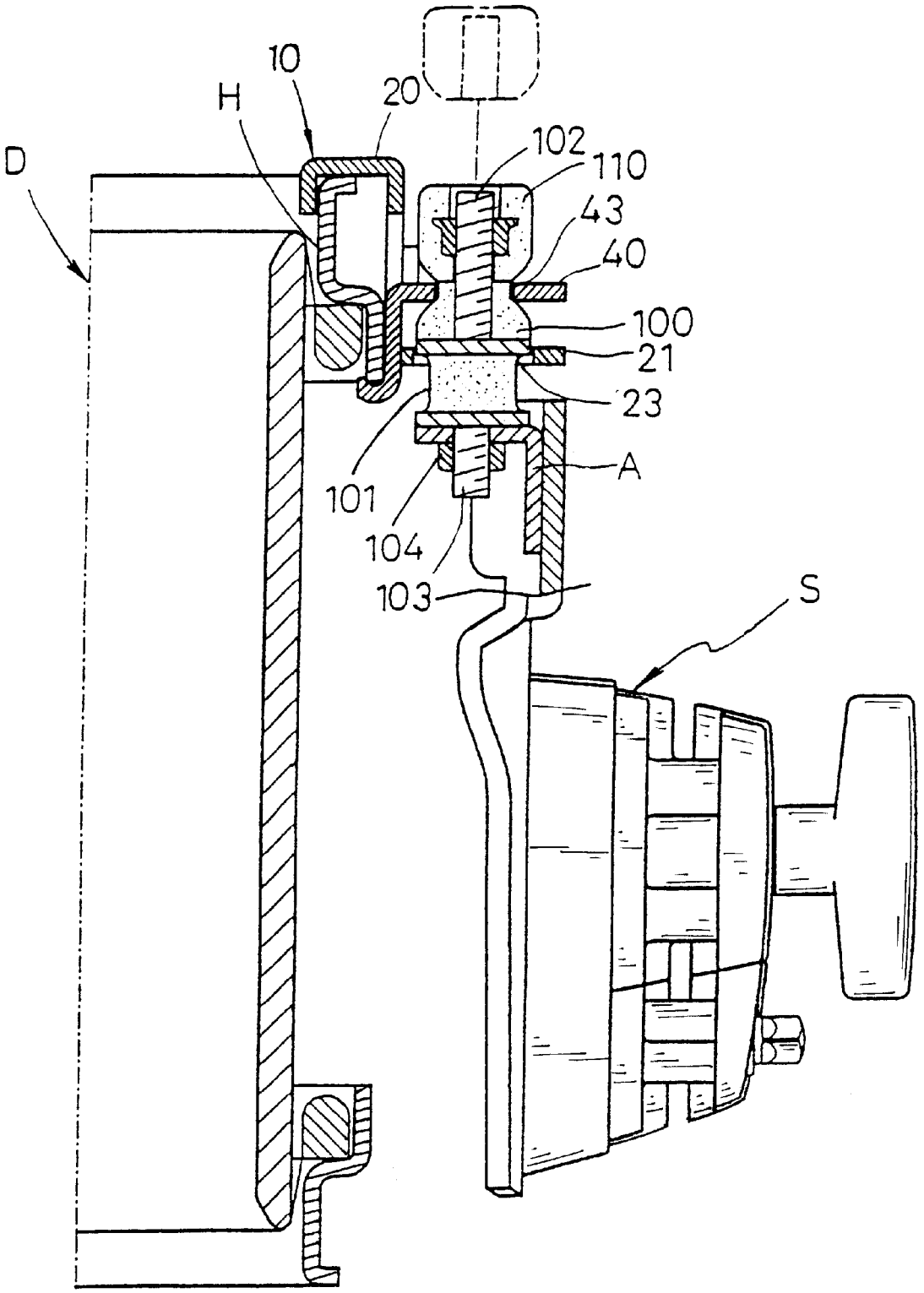
FIG. 6 is a cross-section along line 6—6 in FIG. 5.
Figure 7:
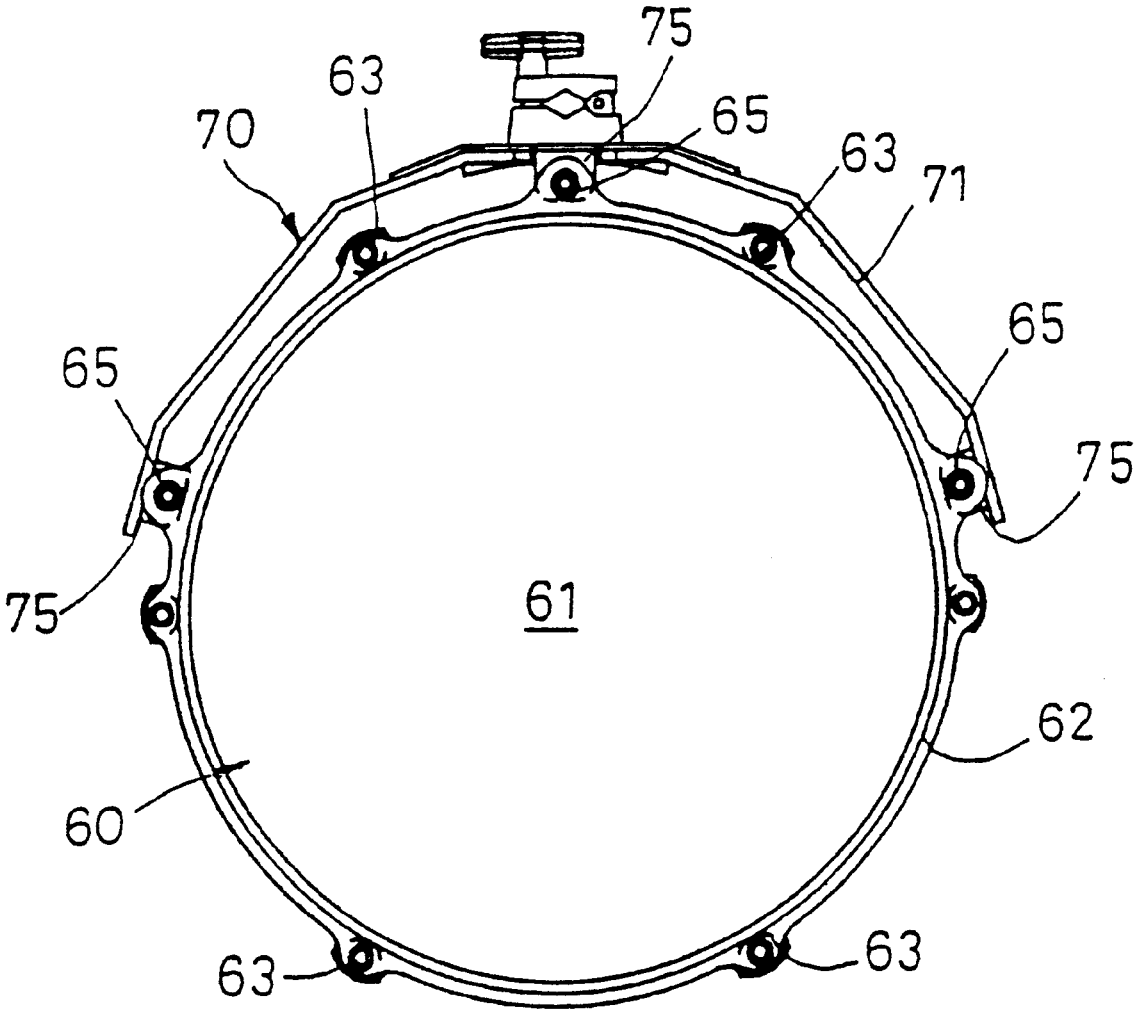
FIG. 7 is the same view as FIG. 5 showing a prior art embodiment.

Next, a tool installed through this tool connecting adaptor 10 is explained. FIGS. 4, 5 and 6 show examples of installation of the drum support tool S.

In the FIG. 4 example, tool connecting adaptors 10 have been installed at three locations around the drum hoop H. The arm A of the support S is installed as shown in FIG. 5 against the adaptors 10 and around the main drum body or trunk.

The connecting adaptor 10 and the arm A of the support S are installed by an installation bolt 100 and a tightening nut 110, as shown in FIG. 6. In this example, the installation holes 23 and 43 for the connection of a tool (drum support S) are formed respectively in the first seating plate 21 of the first member 20 and the second seating plate 41 of the second member 40. The installation bolt 100 is inserted into the holes 23 and 43.

The installation bolt 100 has a vibration preventing rubber construction and the screws 102 and 103 of that bolt protrude above and below such a vibration absorbent 101 material, e.g. rubber, etc. as shown in the drawing. The lower screw 103 is fixed to the arm A by a nut 104. A vibration absorbent is provided at the part of the upper screw 102 which contacts the installation hole 43 of the second seating plate 40, and the screw is exposed at its part that protrudes from the installation hole 43. Screwing the tightening nut 110 that has been covered by a vibration absorbent material likewise to this upper screw 102 causes either attachment or detachment of the drum support S.

In addition to a drum support, a microphone or accessories, etc. can be installed on the tool connecting adaptor 10 for the drum.

The tool connecting adaptor for the drum according to the invention enables installation of a support member or various tools on a drum hoop even for ordinary drums which have no installation part. The tool connecting adaptor for the drum as described enables firm fixing in a simple manner against the drum hoop whose shape is a fine ring, thereby making it possible to hold various tools stably.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A connecting adaptor for attaching a tool or the like to the outside of a musical instrument drum, the adaptor comprising:

a first member including a first seating plate at an orientation outward from the drum body, a first adjustment element receiver on the first seating plate, the first seating plate having a front edge toward the drum body;

a first front plate attached to the first seating plate and extending up therefrom; a first opening through the front plate defined by a first vertically oriented edge at the front of the first seating plate and extending across the first opening; a first upper drum engaging part at the top of the first front plate for engaging a part of the drum from above the front plate having a rear side;

a second member including a second seating plate disposed above the first seating plate;

an adjustment device between the first and second seating plates for selectively moving the first and second seating plates apart or permitting them to be moved toward each other;

a hanging part hanging from the second seating plate and shaped for passing through the first opening so that the hanging part in the first opening depends beneath the first seating plate; the hanging part having a rear surface engageable with the first edge in the first opening of the first member; a second lower drum engaging part on the hanging part which is engageable with a part of the drum from below;

a side plate at least one of the sides of the hanging part and positioned for engaging the rear side of the front plate in a freely sliding manner so that the first and second members are guided for sliding vertically with respect to each other and prevented from sliding forwardly and rearwardly relative to each other;

whereby with the hanging part in the first opening, the rear of the hanging part engages the vertical edge of the first opening, and the side plate engages the rear side of the front seat plate; the adjustment device being operable for moving the first and second seating plates apart for causing the upper engaging part of the first member and the lower engaging part of the second member to move toward each to engage the part of the drum for fixing the adaptor to the drum.

2. The adaptor of claim 1, further comprising a tool connection provided in at least one of the first and second seating plates.

3. The adaptor of claim 2, wherein the tool connection is provided in both the seating plates.

4. The adaptor of claim 3, wherein the tool connection in each of the first and second seating plates comprises a hole through each of the seating plates.

5. The adaptor of claim 1, wherein the adjustment device comprises a screw in one of the seating plates movable toward and away from the other of the seating plates and the receiver in the other receiving plates receives screw.

6. The adaptor of claim 1, wherein the adjustment device comprises a screw in the first seating plate which is adjustable with reference to the first of the seating plates into engagement with the second of the seating plates for adjusting the distance between the seating plates.

* * * * *